US008113162B2

(12) United States Patent
Sumiya et al.

(10) Patent No.: US 8,113,162 B2
(45) Date of Patent: Feb. 14, 2012

(54) CYLINDER HEAD COVER

(75) Inventors: Yoshiaki Sumiya, Kariya (JP); Takahiro Yamazaki, Okazaki (JP); Kazuya Yoshijima, Okazaki (JP)

(73) Assignees: Toyota Boshoku Kabushiki Kaisha, Aichi-ken (JP); Oyota Jidosha Kabushiki Kaisha, Aichi-ken (JP)

( * ) Notice: Subject to any disclaimer, the term of this patent is extended or adjusted under 35 U.S.C. 154(b) by 386 days.

(21) Appl. No.: 12/404,572

(22) Filed: Mar. 16, 2009

(65) Prior Publication Data

US 2009/0235892 A1 Sep. 24, 2009

(30) Foreign Application Priority Data

Mar. 18, 2008 (JP) ..... 2008-069945

(51) Int. Cl.
*F01M 9/10* (2006.01)

(52) U.S. Cl. ..... 123/90.38; 123/90.17; 123/195 C

(58) Field of Classification Search ..... 123/90.15, 123/90.16, 90.17, 90.31, 90.12, 90.38, 195 C
See application file for complete search history.

(56) References Cited

U.S. PATENT DOCUMENTS 7,121,243 B2 * 10/2006 Yoshijima et al. ..... 123/90.38

FOREIGN PATENT DOCUMENTS

| | | |
|---|---|---|
| JP | 2006-017085 A | 1/2006 |
| JP | 2006-46191 | 2/2006 |
| JP | 2006-64158 | 3/2006 |
| JP | 2006-316640 | 11/2006 |
| JP | 2007-107484 | 4/2007 |

OTHER PUBLICATIONS

English language Abstract of JP 2006-64158, Mar. 9, 2006.
English language Abstract of JP 2006-46191, Feb. 16, 2006.
English language Abstract of JP 2007-107484, Apr. 26, 2007.
English language Abstract of JP 2006-316640, Nov. 24, 2006.
English language Abstract of JP 2006-017085 A, Jan. 19, 2006.
U.S. Appl. No. 12/246,764 to Katayama et al., filed Oct. 7, 2008.

* cited by examiner

*Primary Examiner* — Zelalem Eshete
(74) *Attorney, Agent, or Firm* — Greenblum & Bernstein, P.L.C.

(57) ABSTRACT

A tubular valve casing formed of metal is molded with an outer shell portion formed of synthetic resin. A valve body is inserted into the valve casing through an opening formed at an end of the valve casing and incorporated in the valve casing. An annular projection is formed in the outer shell portion and projects toward the end surface of the valve casing corresponding to the opening. A seal ring is arranged between the projection and the valve body.

7 Claims, 6 Drawing Sheets

CYLINDER HEAD COVER

BACKGROUND OF THE INVENTION

The present invention relates to a cylinder head cover attached to an upper portion of a cylinder head of an engine and, more particularly, to a cylinder head cover incorporating an oil control valve for controlling hydraulic oil.

Conventionally, as one such type of cylinder head cover, a configuration disclosed in, for example, Japanese Laid-Open Patent Publication No. 2006-17085 has been proposed. FIG. 8 shows the conventional configuration. As illustrated in FIG. 8, a tubular valve casing 32 is molded integrally with an outer shell portion 31*a* of a cylinder head cover 31. The outer shell portion 31*a* is formed of synthetic resin and the valve casing 32 is formed of metal. A valve body 33 of an oil control valve is inserted into the valve casing 32 through an opening 32*a*, which is formed at one end of the valve casing 32, and is incorporated in the valve casing 32. A seal ring 34 is attached to a portion of the outer circumference of the valve body 33 located in the vicinity of the opening 32*a* of the valve casing 32. The seal ring 34 is arranged between the inner circumferential surface of the valve casing 32 and the outer circumferential surface of the valve body 33.

The outer shell portion 31*a* formed of synthetic resin and the valve casing 32 formed of metal have different heat expansion coefficients. Accordingly, if, for example, the temperature in the engine compartment rises, a gap may form in a boundary portion 35 between the outer shell portion 31*a* and the valve casing 32, leading to leakage of oil.

To solve the problem, the following configurations, for example, have been proposed conventionally.

(1) With adhesive applied to the outer circumferential surface of the valve casing 32, the outer shell portion 31*a* of the cylinder head cover 31 is molded onto the outer circumference of the valve casing 32. This bonds and fixes the outer shell portion 31*a* and the valve casing 32 to each other at the boundary portion 35.

(2) With reference to FIG. 9, an annular groove 36 is provided in the outer circumferential surface of the valve casing 32. The groove 36 is filled with synthetic resin at the same time as the outer shell portion 31*a* is molded. The resin in the groove 36 is integrated with the resin forming the outer shell portion 31*a*.

(3) Also referring to FIG. 9, a seal ring 37 formed of elastic foaming material is attached to the outer circumferential surface of the valve casing 32 and then, in this state, the outer shell portion 31*a* of the cylinder head cover 31 is molded. In this manner, the boundary portion 35 between the outer shell portion 31*a* and the valve casing 32 is sealed by the seal ring 37 held in a compressed state.

(4) As illustrated in FIG. 10, an annular groove 36 is formed in the outer circumferential surface of the valve casing 32 and a gel-like sealing material 40 is caused to fill the groove 36 and caused to foam. When the outer shell portion 31*a* is molded, the synthetic resin in the groove 36 and the synthetic resin forming the outer shell portion 31*a* are integrated, and the boundary portion 35 is sealed by the seal ring 37 in the compressed state.

However, in the method using the adhesive as described in the item (1), when the synthetic resin is caused to fill a mold with the valve casing 32 set in the mold to form the outer shell portion 31*a*, the pressure of the synthetic resin, which is to be molded, is likely to urge the adhesive to flow out of the outer circumferential surface of the valve casing 32. This may make it impossible to effectively bond the outer shell portion 31*a* and the valve casing 32 together with the adhesive. Further, if the flowed out adhesive remains on the outer end surface of the valve casing 32, the appearance is degraded. Also, if the adhesive remains in the outer shell portion 31*a* as impurity, the oil may leak from the corresponding portion of the outer shell portion 31*a*.

If the method using the groove 36 as described in the above item (2) is employed, the outer shell portion 31*a* and the valve casing 32 can be fixed by the anchor effect so that the outer shell portion 31*a* and the valve casing 32 are not displaced with respect to each other. However, the formation of a gap between the valve casing 32 and the outer shell portion 31*a* cannot be prevented. Thus, the oil is likely to leak from the boundary portion 35.

In the method employing the seal ring 37 as described in the above items (3) and (4), when the synthetic resin is caused to fill the mold in which the valve casing 32 is set in order to form the outer shell portion 31*a*, the filling pressure of the synthetic resin must be set to an appropriate value. Otherwise, the seal ring 37 may not be allowed to seal the boundary portion 35. Specifically, if the filling pressure is insufficient, the seal ring 37 cannot be compressed to an appropriate extent and repulsive force necessary for sealing cannot be ensured. In contrast, if the filling pressure is excessively high, a great amount of synthetic resin may go over a parting line of the mold and causes a burr in a product. This complicates the post-molding process since the burr must be removed.

SUMMARY OF THE INVENTION

The present invention was made for solving the above problems in the prior art. It is an objective of the invention to provide a cylinder head cover that prevents oil from leaking to the exterior from a boundary portion between an outer shell portion formed of synthetic resin and a valve casing formed of metal.

To achieve the foregoing objective and in accordance with one aspect of the present invention, a cylinder head cover including an outer shell portion, a tubular valve casing, a valve body, an annular projection, and a seal ring is provided. The outer shell portion is formed of a synthetic resin. The tubular valve casing is formed of a metal and molded with the outer shell portion. The valve body is inserted into the valve casing through an opening formed at an end of the valve casing and incorporated in the valve casing. The annular projection is formed in the outer shell portion and projects toward the opening of the valve casing in such a manner as to cover a boundary portion between the outer shell portion and the valve casing. The seal ring is arranged between the projection and the valve body.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First Embodiment

Figure 1:
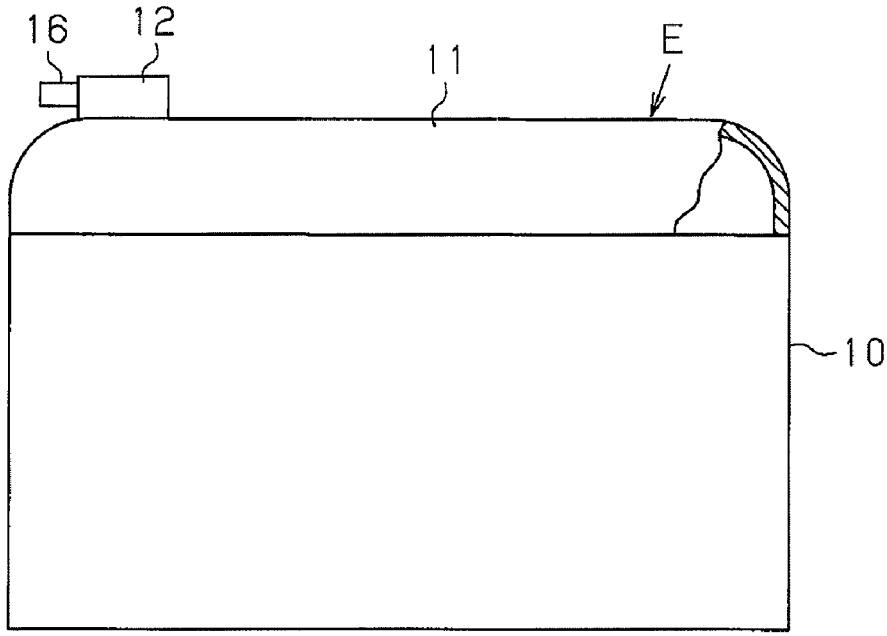
FIG. 1 is a schematic diagram showing an engine with a cylinder head cover according to one embodiment of the present invention.
Figure 2:
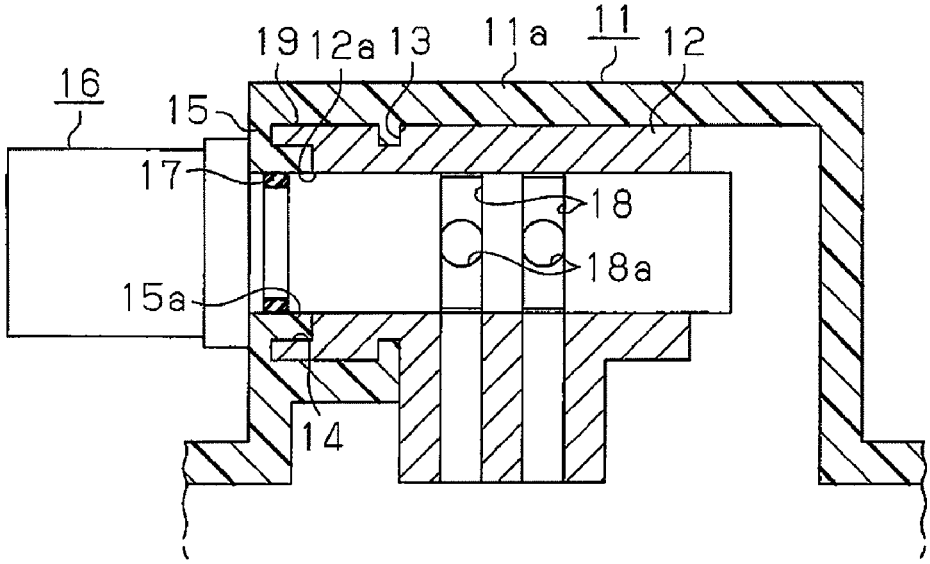
FIG. 2 is a cross-sectional view showing a portion of a cylinder head cover according to a first embodiment.
Figure 3:
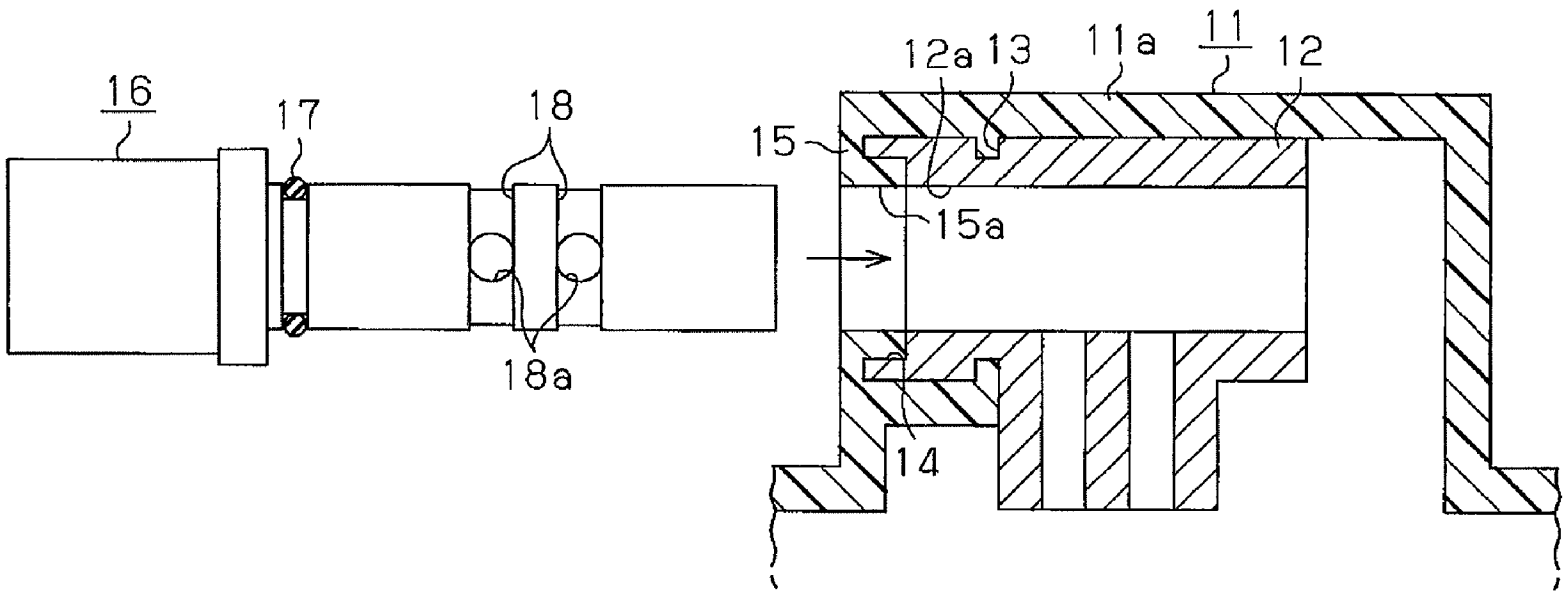
FIG. 3 is an exploded cross-sectional view showing a portion of the cylinder head cover illustrated in FIG. 2.

A first embodiment of the present invention will now be described with reference to FIGS. 1 to 3. As shown in FIG. 1, a cylinder head cover 11 is fixed to an upper portion of a cylinder block (which includes a cylinder head) of an engine 10. With reference to FIG. 2, an outer shell portion 11*a* of the cylinder head cover 11 is molded as an integral body using heat-resistant synthetic resin. A cylindrical valve casing 12 formed of metal is molded with the outer shell portion 11*a*. A groove 13 is formed in the outer circumference of the valve casing 12. The groove 13 is filled with synthetic resin when the outer shell portion 11*a* is molded. This fixes the outer shell portion 11*a* and the valve casing 12 so that the outer shell portion 11*a* and the valve casing 12 are not displaced with respect to each other.

An opening 12*a* is formed in an outer end (the left end as viewed in FIG. 2) of the valve casing 12. An annular recess 14 is provided in the inner circumference of the opening 12*a*. An annular projection 15, which projects toward the opening 12*a*, is formed in the outer shell portion 11*a* of the cylinder head cover 11. A cylindrical entering portion 15*a* projects from the inner edge of the projection 15. The entering portion 15*a* is inserted into the recess 14 along the axial direction of the recess 14. The outer end of the valve casing 12 is thus clamped by the entering portion 15*a* and the outer shell portion 11*a* from inside and outside.

A valve body 16 of an oil control valve is inserted from the opening 12*a* of the valve casing 12 and incorporated in the valve casing 12. A seal ring 17 is attached to a portion of the outer circumference of the valve body 16 corresponding to the opening 12*a* of the valve casing 12. The seal ring 17 is located between the inner circumferential surface of the entering portion 15*a* of the projection 15 and the outer circumferential surface of the valve body 16. A plurality of oil grooves 18 having oil holes 18*a* are formed in the outer circumferential surface of the valve body 16. The inner end (the right end as viewed in FIG. 2) of the entering portion 15*a* is arranged in such a manner that, when the valve body 16 is incorporated in the valve casing 12, this end is located outward from the outermost one of the oil grooves 18.

In the cylinder head cover 11 constructed as described above, the sealing performance between the valve casing 12 and the valve body 16 is maintained through the engagement between the entering portion 15*a* and the seal ring 17. As a result, even if a gap forms between the valve casing 12 and the outer shell portion 11*a*, the gap is prevented from communicating with the exterior.

The first embodiment has the following advantages.

(1) The annular projection 15, which is provided in the outer shell portion 11*a*, covers the boundary portion 19 between the inner circumferential surface of the outer shell portion 11*a* and the outer circumferential surface of the valve casing 12. Further, the seal ring 17, which is attached to the outer circumference of the valve body 16, seals the boundary portion between the inner circumferential surface of the projection 15 and the outer circumferential surface of the valve body 16. This configuration prevents oil from leaking to the exterior from the boundary portion 19 between the outer shell portion 11*a* formed of synthetic resin and the valve casing 12 formed of metal.

(2) The entering portion 15*a* extending from the inner edge of the projection 15 is inserted into the recess 14, which is formed in the inner surface of the end of the valve casing 12. The end of the valve casing 12 in the vicinity of the opening 12*a* is clamped by the entering portion 15*a* and the outer shell portion 11*a*. This suppresses deformation of the projection 15 in a manner separating from the end surface of the opening 12*a* of the valve casing 12 due to the difference between the thermal expansion rate of the outer shell portion 11*a* formed of synthetic resin and the thermal expansion rate of the valve casing 12 formed of metal. This, in turn, suppresses movement of the outer shell portion 11*a* caused by such deformation. Formation of a gap between the outer shell portion 11*a* and the valve casing 12 is thus prevented and, as a result, leakage of the oil to the exterior is effectively prevented.

(3) As has been described, since leakage of the oil to the exterior is prevented, it is unnecessary to apply adhesive between the outer shell portion 11*a* and the valve casing 12. As a result, degradation of the appearance caused by the adhesive that has been urged to flow out is prevented.

Second Embodiment

A second embodiment of the present invention will hereafter be explained mainly about the differences from the first embodiment.

Figure 4:
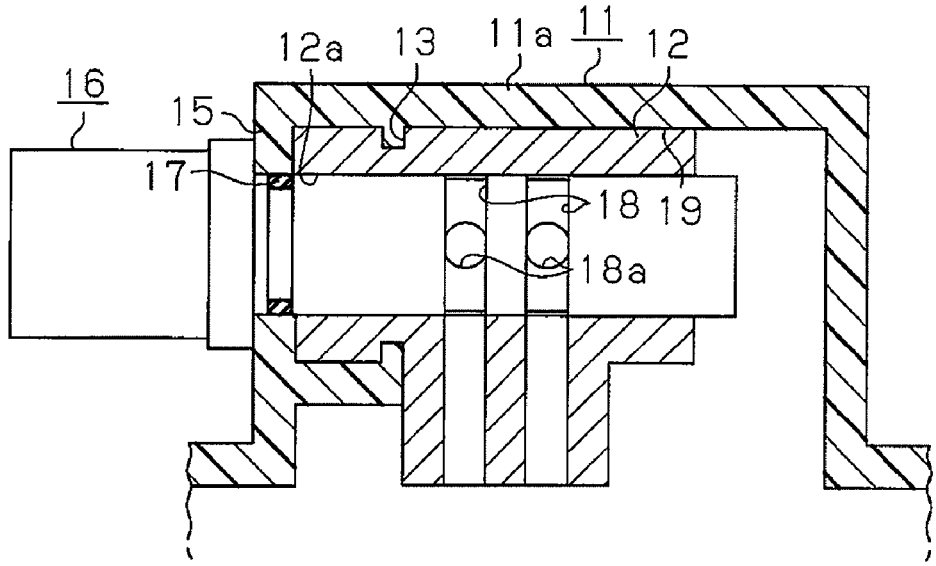
FIG. 4 is a cross-sectional view showing a portion of a cylinder head cover according to a second embodiment of the invention.

As illustrated in FIG. 4, the recess 14 formed in the valve casing 12 and the entering portion 15*a* formed in the projection 15 of the first embodiment are omitted in the second embodiment. The radius of the inner circumferential surface of the projection 15 and the radius of the inner circumferential surface of the opening 12*a* of the valve casing 12 are substantially equal. These inner circumferential surfaces are coaxial. The seal ring 17 is arranged between the inner circumferential surface of the projection 15 and the outer circumferential surface of the valve body 16.

Accordingly, in the second embodiment, the advantages substantially equivalent to those of the first embodiment are obtained. Since the second embodiment is configured without the entering portion 15*a*, a gap may form easily between the outer shell portion 11*a* and the valve casing 12, compared to the first embodiment. However, even without the entering portion 15*a*, the engagement between the seal ring 17 and the projection 15 of the outer shell portion 11*a* prevents leakage of oil to the exterior.

Third Embodiment

A third embodiment of the present invention will now be described mainly about the differences from the first embodiment.

Figure 5:
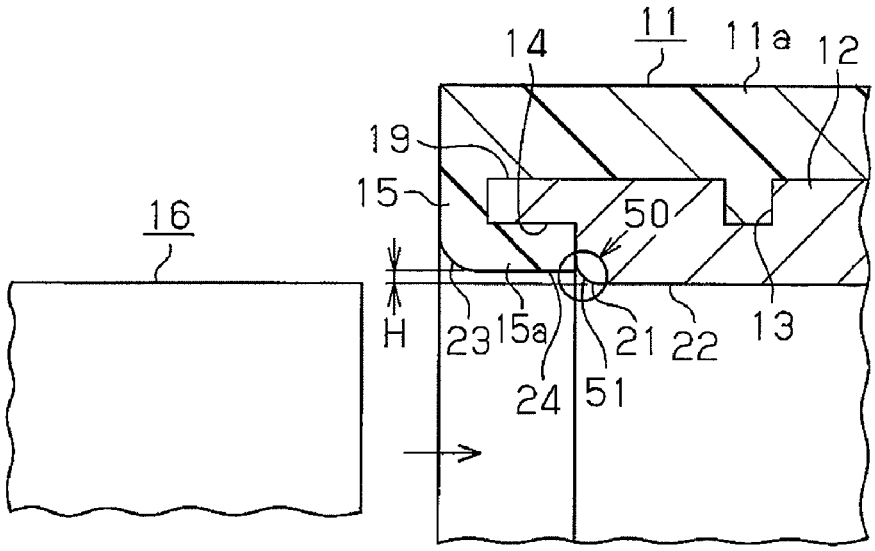
FIG. 5 is a cross-sectional view showing a portion of a cylinder head cover according to a third embodiment of the invention.

As illustrated in FIG. 5, the third embodiment is configured to included the annular projection 15 formed in the outer shell portion 11*a* and the cylindrical entering portion 15*a* extending from the inner edge of the projection 15, as in the first embodiment. An inner circumferential surface 24 of the entering portion 15*a* is provided at a position outward from an inner circumferential surface 22 of the valve casing 12 by a distance H in the radial direction of the inner circumferential surfaces 24, 22. In other words, a step 50, by which the inner circumferential surface 24 of the entering portion 15*a* retreats radially outward, is formed at a boundary portion between the inner circumferential surface 24 of the entering portion 15*a* and the inner circumferential surface 22 of the valve casing 12. The step 50 provides a non-molded surface 51, which is not covered by the outer shell portion 11*a*, at an end of the valve casing 12 and at the boundary between the inner circumferential surface 22 of the valve casing 12 and the inner circumferential surface 24 of the entering portion 15*a*. The aforementioned distance H is set in such a range that the distance H is smaller than the deformation amount of the seal ring 17 and does not influence the sealing performance of the seal ring 17.

An arcuate surface 21 is formed on the inner edge of the opening 12*a* of the valve casing 12, specifically, in a portion adjacent to the entering portion 15*a* at the inner edge of the opening 12*a*. An arcuate surface 23 is formed on the inner edge of the outer opening (the left side as viewed in FIG. 5) of the entering portion 15*a*.

Accordingly, the third embodiment has the following advantages in addition to the advantages substantially equivalent to those of the first embodiment.

(4) The step 50, by which the inner circumferential surface 24 of the entering portion 15*a* retreats radially outward, is formed in the boundary portion between the entering portion 15*a* and the valve casing 12. Accordingly, if burr is formed in a portion of the outer shell portion 11*a* adjacent to the valve casing 12 when the outer shell portion 11*a* is molded, the step 50 prevents the burr from projecting toward the inner circumferential surface 22 of the valve casing 12. As a result, when the valve body 16 is inserted into and incorporated in the valve casing 12, the burr is prevented from being caught between the valve body 16 and the valve casing 12 or being cut off and falling in the cylinder head cover 11.

(5) The arcuate surface 23 and the arcuate surface 21 are formed in the entering portion 15*a* and the valve casing 12, respectively. As a result, when the valve body 16 is inserted into and incorporated in the valve casing 12, damage to the seal ring 17 is suppressed while such incorporation is smoothly accomplished.

Fourth Embodiment

A fourth embodiment of the present invention will hereafter be explained mainly about the differences from the third embodiment.

Figure 6:
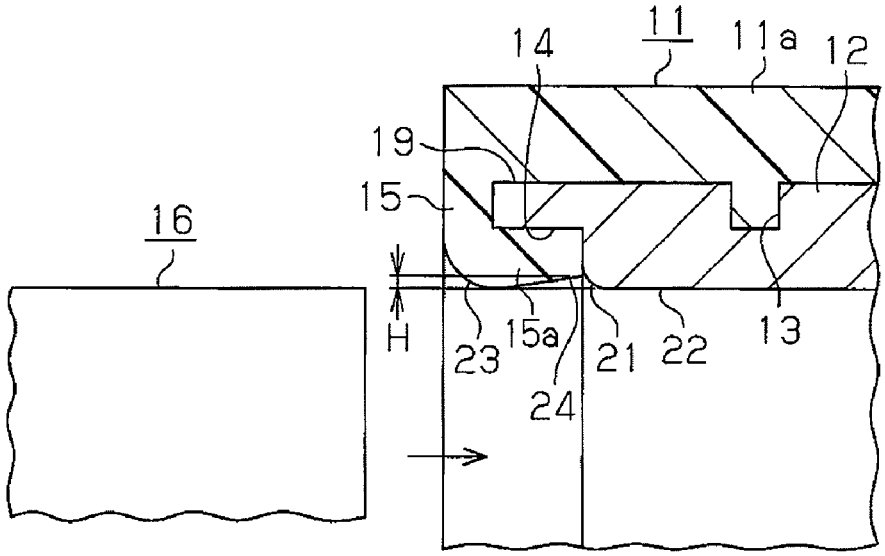
FIG. 6 is a cross-sectional view showing a portion of a cylinder head cover according to a fourth embodiment of the invention.

In the fourth embodiment, as illustrated in FIG. 6, the inner circumferential surface 24 of the entering portion 15*a* is inclined in such a manner that the radius of the cross section of the inner circumferential surface 24 becomes greater toward the inner side (the right side as viewed in FIG. 6) in the valve casing 12.

The fourth embodiment has the following advantage in addition to the advantages substantially equivalent to those of the third embodiment.

(6) When the seal ring 17 arranged on the valve body 16 and the inner circumferential surface 24 are engaged with each other, force is generated on the inner circumferential surface 24 and presses the seal ring 17 toward the inner side of the entering portion 15*a*. This prevents the seal ring 17 from deforming outward (to the left side as viewed in FIG. 6) with respect to the inner circumferential surface 24. The valve body 16 is thus maintained stably in a mounted state.

Fifth Embodiment

A fifth embodiment of the present invention will now be described mainly about the differences from the first embodiment.

Figure 7:
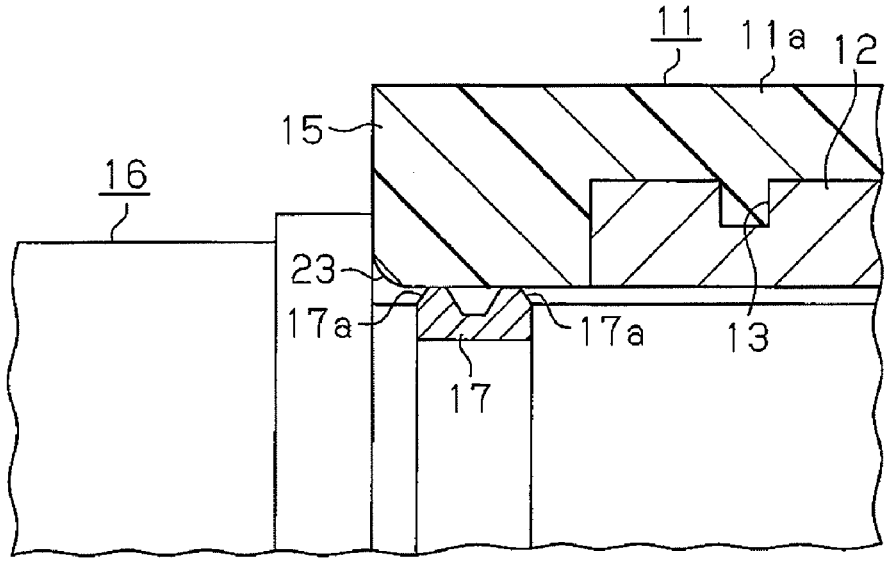
FIG. 7 is a cross-sectional view showing a portion of a cylinder head cover according to a fifth embodiment of the invention.
Figure 8:
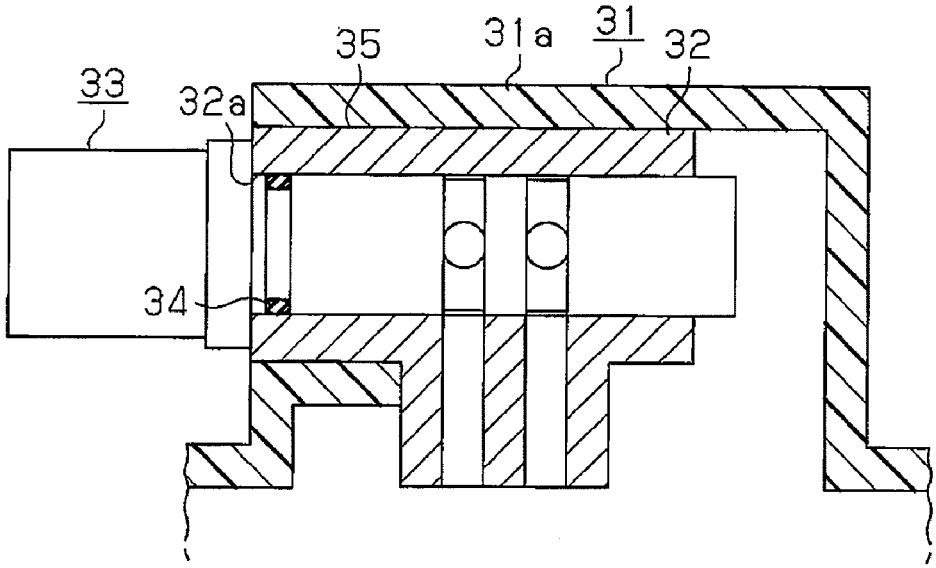
FIG. 8 is a cross-sectional view showing a portion of a conventional cylinder head cover.
Figure 9:
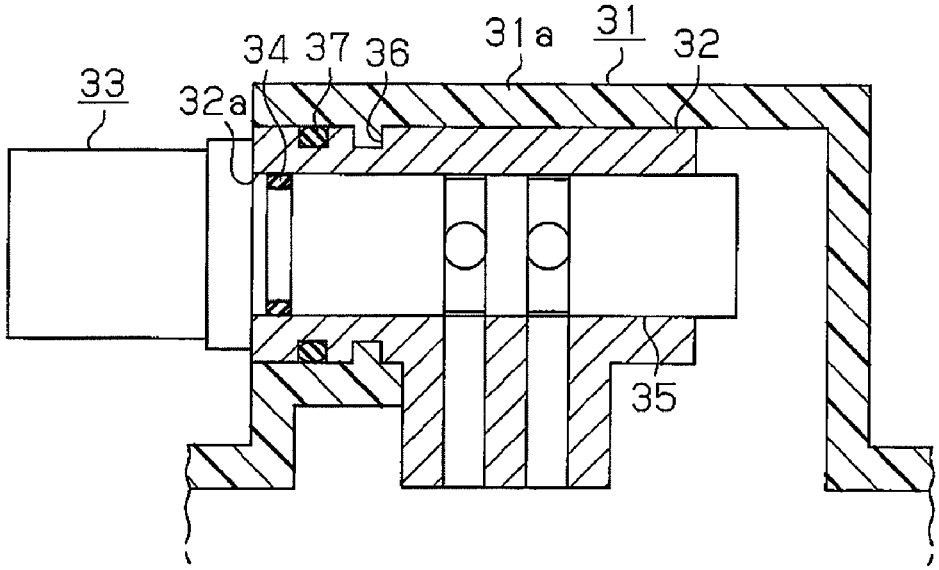
FIG. 9 is a cross-sectional view showing a portion of another conventional cylinder head cover.
Figure 10:
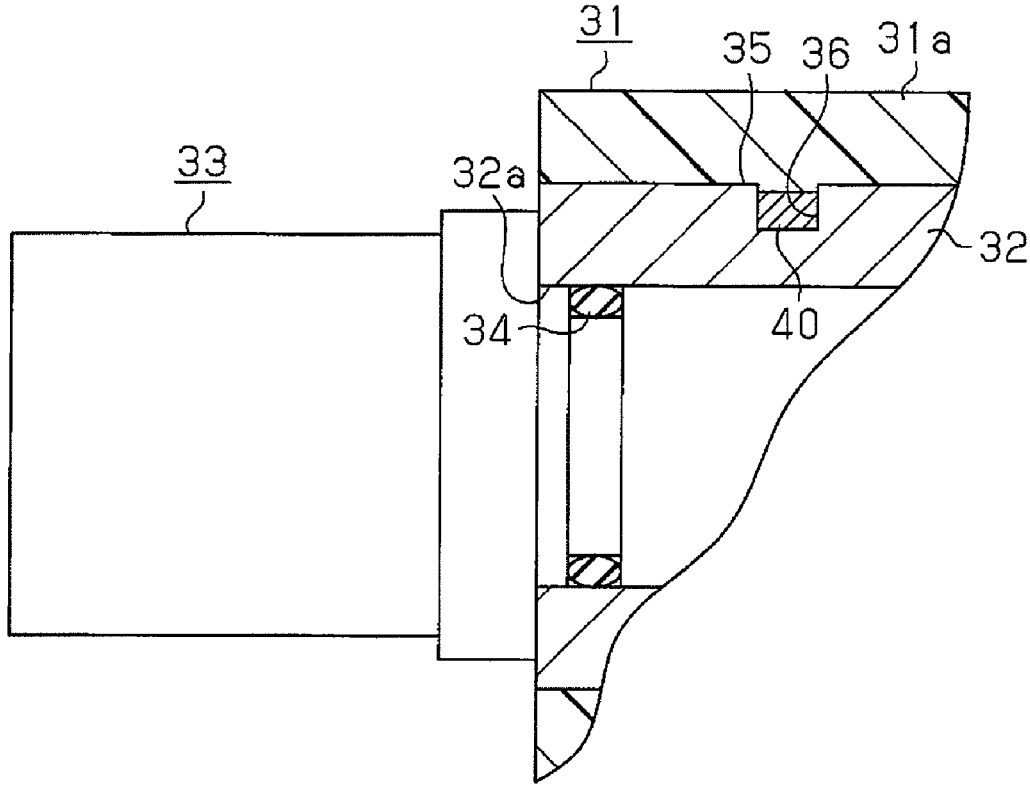
FIG. 10 is a cross-sectional view showing a portion of another conventional cylinder head cover.

With reference to FIG. 7, in the fifth embodiment, a lip seal having a plurality of lip portions 17*a* is employed as the seal ring 17 arranged on the valve body 16. The lip portions 17*a* are held in contact with the inner circumferential surface of the projection 15.

The fifth embodiment has the following advantages in addition to the advantages substantially equivalent to those of the first embodiment.

(7) The seal ring 17 having the multiple lip portions 17*a* enhances the sealing performance between the projection 15 and the valve body 16 without increasing the surface pressure of the seal ring 17 acting on the projection 15.

(8) Even if the surface pressure of the seal ring 17, or the force acting on the projection 15 of the outer shell portion 11*a* in a radially outward direction, is small, the sealing performance of the seal ring 17 is ensured. This suppresses deformation of the outer shell portion 11*a* in a direction separating from the valve casing 12. Formation of a gap between the outer shell portion 11*a* and the valve casing 12 is thus prevented.

MODIFIED EXAMPLES

The illustrated embodiments may be modified as follows.

In the configuration with the entering portion 15*a* formed at the inner edge of the projection 15 as in the first embodiment, the lip seal 17 having the multiple lip portions 17*a* may be employed as in the fifth embodiment.

In the configuration without the entering portion 15*a* as in the second embodiment, a step may be formed between the inner circumferential surface of the projection 15 and the inner circumferential surface of the valve casing 12 as in the third embodiment. Further, as in the fourth embodiment, arcuate portions may be formed at the inner edge of the valve casing 12 or the inner edge of the projection 15.

The inner circumferential surface 24 of the entering portion 15*a* may be inclined in the direction opposite to that of the third embodiment. In other words, the inner circumferential surface 24 may be inclined in such a manner that the inner circumferential surface 24 retreats further along a direction toward the outer side of the valve casing 12.

An annular groove may be formed in the inner circumferential surface of the projection 15 or the entering portion 15*a*, and a seal ring engaged with the outer circumferential surface of the valve body 16 may be fitted in the annular groove.

Therefore, the present examples and embodiments are to be considered as illustrative and not restrictive and the invention is not to be limited to the details given herein, but may be modified within the scope and equivalence of the appended claims.

What is claimed is:

1. A cylinder head cover comprising:

an outer shell portion formed of a synthetic resin;

a tubular valve casing that is formed of a metal and molded with the outer shell portion;

a valve body that is inserted into the tubular valve casing through an opening formed at an end of the tubular valve casing and incorporated in the tubular valve casing:

an annular projection that is formed in the outer shell portion and projects toward the opening of the tubular valve casing in such a manner as to cover a boundary portion between the outer shell portion and the tubular valve casing; and a seal ring arranged between the annular projection and the valve body, wherein the annular projection has an entering portion that enters an interior of the tubular valve casing along the axial direction of the tubular valve casing.

2. The cylinder head cover according to claim 1, wherein an end of the tubular valve casing that corresponds to the opening is clamped between the entering portion and the outer shell portion, and wherein the seal ring is arranged between the entering portion and the valve body.

3. The cylinder head cover according to claim 2, wherein an inner circumferential surface of the entering portion is inclined in such a manner that a radius of the inner circumferential surface becomes greater toward an inner side of the tubular valve casing.

4. The cylinder head cover according to claim 1, wherein a step is formed in a boundary portion between an inner circumferential surface of the annular projection and an inner circumferential surface of the tubular valve casing, and wherein a non-molded surface that is not covered by the outer shell portion is provided in the tubular valve casing.

5. The cylinder head cover according to claim 1, wherein an arcuate portion is formed in an inner edge of an outer opening of the annular projection.

6. The cylinder head cover according to claim 1, wherein an arcuate portion is provided in an inner edge of the opening of the tubular valve casing.

7. The cylinder head cover according to claim 1, wherein the seal ring includes a plurality of lip portions.

* * * * *